US007993182B2

(12) United States Patent
Horton et al.

(10) Patent No.: US 7,993,182 B2
(45) **Date of Patent: *Aug. 9, 2011**

(54) COSMETIC APPLIANCES AND METHODS OF USE

(75) Inventors: Denise Horton, Westlake Village, CA (US); Andrea Niemiec-Perrigo, Westlake Village, CA (US)

(73) Assignee: Bring It Up, Inc., Westlake Village, CA (US)

( * ) Notice: Subject to any disclaimer, the term of this patent is extended or adjusted under 35 U.S.C. 154(b) by 144 days.

This patent is subject to a terminal disclaimer.

(21) Appl. No.: 11/953,085

(22) Filed: Dec. 10, 2007

(65) Prior Publication Data

US 2009/0149114 A1 Jun. 11, 2009

(51) Int. Cl.
*A41C 3/00* (2006.01)
*A41D 3/00* (2006.01)

(52) U.S. Cl. ..... 450/81; 450/1

(58) Field of Classification Search ..... 450/81, 450/38, 37, 39, 54–58; 2/267, 268
See application file for complete search history.

(56) References Cited

U.S. PATENT DOCUMENTS 4,553,550 A * 11/1985 Hattori ..... 450/81
4,640,288 A * 2/1987 Hattori ..... 450/81
5,776,177 A * 7/1998 MacWhinnie et al. ..... 607/108
6,200,195 B1 * 3/2001 Furuno et al. ..... 450/81
6,371,831 B1 * 4/2002 Dodge ..... 450/81

* cited by examiner

*Primary Examiner* — Gloria Hale
(74) *Attorney, Agent, or Firm* — Lewis Brisbois Bisgaard & Smith LLP

(57) ABSTRACT

A cosmetic appliance and method of use for temporarily lifting, gathering human skin of the breast or smoothing the human breast and skin of the breast, and which is not readily apparent once applied, formed in predetermined shapes from thin, generally translucent flexible sheeting or tape and or of a silicone gel formed into the shape of cup, to one side of which a reusable adhesive has been applied and covered with a peel-away layer for temporarily lifting, gathering, covering or smoothing the skin of the breast, nipple and areola areas, and which is not readily apparent once applied.

3 Claims, 7 Drawing Sheets

COSMETIC APPLIANCES AND METHODS OF USE

CROSS REFERENCE TO RELATED APPLICATION

This application claims the benefit of U.S. patent application Ser. No. 10/955,548, entitled Cosmetic Appliance and Method of Use filed Sep. 29, 2004, which is a continuation of application Ser. No. 10/170,302, filed on Jun. 12, 2002, each of which are incorporated by reference herein.

FIELD OF INVENTION

The invention relates generally to cosmetic breast lifting appliances and methods directed to temporarily altering the appearance and shape of the human breast by lifting and/or repositioning a selected area of skin and underlying tissue and/or smoothing the surface of the of the skin of a selected area of the user's body. Specific preferred embodiments are directed to temporarily lifting from above and altering the appearance and shape of selected areas of human breast by lifting the skin, including its subcutaneous layer, and underlying breast tissue and/or temporarily repositioning the breast portion of the user's body to a higher elevation, as well as, in some embodiments concealing the nipple protrusion relative to a garment or an article of clothing. For convenience references to the topography of the breast will be made by reference to Surgical Anatomy, downloaded from the Internet Jan. 28, 2007, from website http://www.sunmed.org/anatbreast.html, particularly the upper inner quadrant, the upper outer quadrant, the lower outer quadrant and the lower inner quadrant.

BACKGROUND OF INVENTION

Various cosmetic appliances for supporting the breast or improving the smoothness or shape of the breast are known. For example, U.S. Pat. No. 6,666,747 to Buntz discloses a cosmetic plaster or tape in the shape of a spoon or bottle opener having an opening with a width of approximately 25 mm through which the nipple passes to substantially enhance the prominence of the nipple and add to the erotic appeal of the breast. U.S. Pat. No. 6,257,952 to Valentin discloses a strapless and backless bra with upper portions joined together, and that may include a rigid underwire supporter and rigid reinforcement for enhancing the appearance of a user's breasts while providing uniform lift and support. U.S. Pat. No. 7,152,606 to Schindler discloses a nipple cover that includes a flexible material for conforming to a human breast and that is not intended to replace or enhance or provide lift and support to the breast, as with a traditional brassiere. Breasts may sag over time due to a variety of reasons, such as aging, gravity, genetics, weight loss, weight gain, after pregnancy, after nursing, and after breast surgery, whether reconstructive following a mastectomy in which a prosthetic breast is implanted in the chest wall of the patient, or solely cosmetic. Sagging breast are especially due to the effects of aging regardless of whether one has had surgery such as breast implants. Breast implants do not stop the effects of gravity and breasts may sag over time. Accordingly, a need exists to address these conditions by providing an appliance that facilitates lifting the breast to a higher desired position and from above the breast, shaping the breast, gathering smoothing the loose skin around and near the top of the breast and otherwise providing a more natural, smooth, shapelier, youthful appearance to sagging breasts.

SUMMARY OF THE INVENTION

The various described embodiments according to the present invention address problems associated with sagging and loss of firm breast tissue due to age, gravity, nursing, weight changes, etc. and the effect that gravity has on surgically enhanced breasts by providing an appliance that lifts, shapes, gathers and smoothes the loose skin just above the nipple area of a human breast in a way that causes the breast to have a firm, normal appearance.

In certain preferred embodiments a cosmetic appliance is formed of a thin, generally translucent flexible sheet, to one side of which an adhesive has been applied and covered with a peel-away layer. In these embodiments the appliance is cut into predetermined shapes which vary in size, and shape, depending upon the intended area of use upon the body, as well as upon the size of the user's anatomy. It is to be understood and emphasized that a variety of shapes of the appliance may be used to accomplish the desired purpose of lifting and/or gathering and smoothing the skin. The appliance is intended to be disposable, and may be cut from a conventional gas permeable, pressure sensitive adhesive tape, an example of which is 3 M Transpore brand tape, preferably type 983.

In other preferred embodiments a cosmetic appliance is formed of a thin, generally translucent flexible sheet made of a disposable, pressure sensitive adhesive tape of a relatively large size, sufficient to cover part of the both upper and both lower quadrants of a breast, to one side of which an adhesive has been applied and covered with a peel-away layer, and in the center of which a soft, non-abrasive material that covers the nipple has been attached.

These disposable appliances or lifts are utilized by first selecting an appliance of appropriate shape and size it also depends on if the user wants to have the nipple exposed or covered. Next, the peel-away backing is removed from a portion (or optionally, from all) of the appliance to expose the adhesive. Thereafter, a portion of the exposed adhesive surface of the appliance is applied to the skin at a predetermined location and pressure applied to promote adhesion between the appliance and the skin. The adhered appliance is then gently moved in such a manner and direction as to cause the adjacent and/or adjoining skin to be lifted and/or gathered and smoothed and/or repositioned to a higher degree desired by the user. With the appliance in the desired position, the remainder of adhesive is exposed (unless it was optionally exposed initially) and the free or unadhered portion of the appliance is pressed onto the skin to complete its application. With the appliance thus applied, the skin adjacent to the appliance is held in the position desired by the user. Because the appliance is thin, that is of a few mils in thickness, with 1.7 mils being a preferred thickness.

In other embodiments a human breast lift and shaping appliance is formed of a thin, generally nude opaque or translucent, flexible, reusable four-way stretch concave molded silicone gel that has been formed into the general shape of a cup, to one side of which a reusable silicone adhesive has been applied. Preferably the nipple and areola areas are to be covered by the appliance but in those areas the appliance that contacts the nipple does not have the adhesive. The appliance is formed into predetermined shapes, generally in the shape of a cup that varies in size and shape to accommodate a variety of human breasts. A variety of shapes of the appliance may be used to accomplish the desired purposes of lifting the breast from the top of the breast, shaping the breast, gathering and smoothing loose skin, covering the nipple and maintaining the lifted breast in an elevated position. The appliance preferably is formed from a four-way stretch, concave molded silicone gel and has a reusable silicone adhesive on the inside surface. A nipple cover is preferable adhered in the center region of the inside of the lift, with the side of the nipple cover contacting the breast not covered with adhesive.

A general description of the concave, molded silicone form of the appliance and its functions are as follows. The appliance is adapted to provide lift to loose and/or saggy areas of a user's top portion of the breast, skin and subcutaneous skin above and around the areola and to reposition the breast and nipple to a higher place, relative to the users body when in a standing or sitting position. After selecting an appliance, the peel-away backing is removed from a portion (or optionally, from all) to expose the adhesive. Thereafter, a portion of the exposed adhesive surface of the appliance is applied to the skin at a predetermined location, preferably the top left and top right quadrants of the breast and pressure is applied to promote adhesion between the appliance and the skin. The adhered appliance is then gently moved in an upward manner and direction as to cause the adjacent and/or adjoined skin to be lifted from the top to a higher degree desired by the user. With the appliance in the desired position, the remainder of adhesive is exposed (unless it was optionally exposed initially) and the free or unadhered portion of the appliance is pressed onto the skin to complete its application. With the appliance thus applied, the skin adjacent and/or adjoined to the appliance, as well as the underlying breast is held up in the higher position desired by the user.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Reference symbols or names are used in the Figures to indicate certain components, aspects or features shown therein. Reference symbols common to more than one Figure indicate like components, aspects or features shown therein.

DETAILED DESCRIPTION

Figure 1:
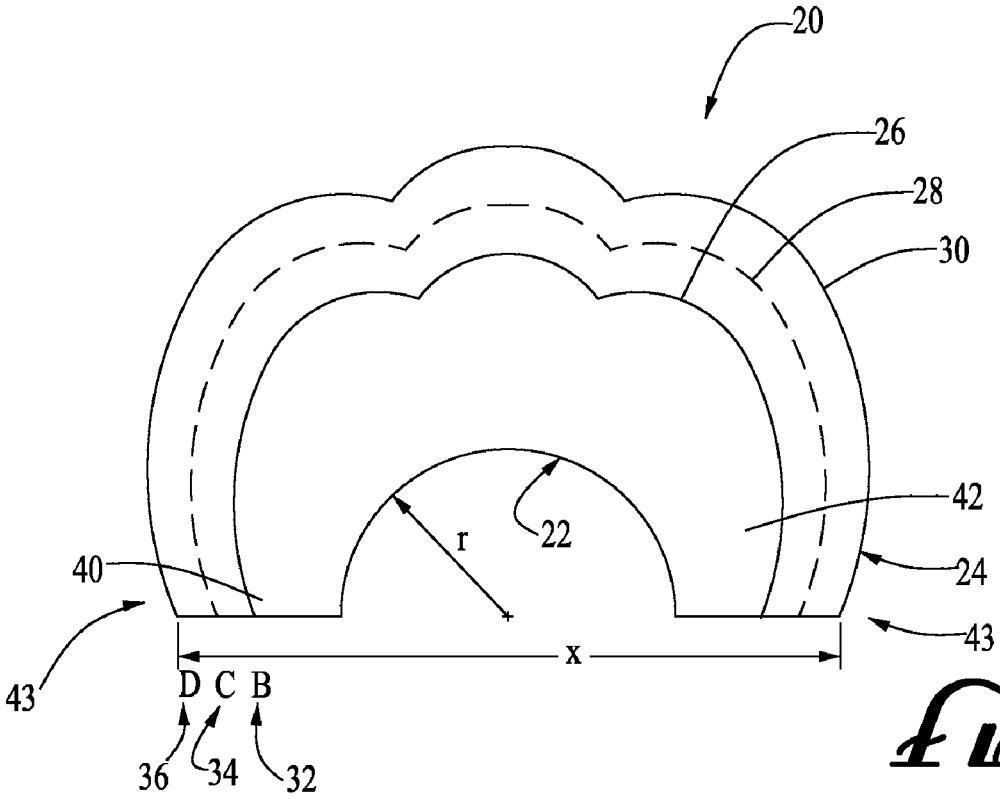
FIG. 1 is a back view of a first embodiment of an appliance for lifting a human breast and gathering and smoothing loose skin of a human breast allowing nipple to be exposed.
Figure 2:
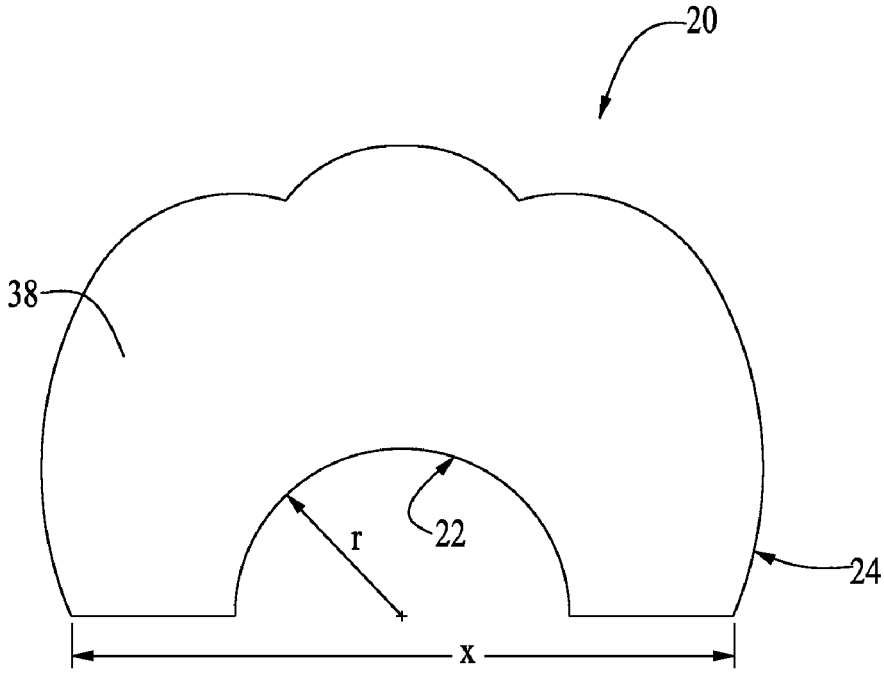
FIG. 2 is a front view of the FIG. 1 embodiment.

FIGS. 1-2 Embodiment

With reference to FIGS. 1-2 a preferred embodiment 20 of the appliance intended for use in lifting and repositioning the breasts to a higher elevation and for lifting the exposed nipple area of the breast to a higher elevation is shown. The appliance and its various embodiments may be referred to as a "lift" herein. With reference to the FIG. 1 back view, the appliance 20 is made of a flat disposable adhesive tape, preferably 3 M 9830 and has a generally semi-annular shape, with the inner perimeter of the annulus 22 preferably semi-circular with a radius of curvature r, and the outer perimeter of the annulus 24 preferably having a curved border, composed of one or more curves. The preferred radius r of the inner perimeter 22 is approximately 1 inch, but includes a range of radii of about 0.5 inch to about 1.5 inches. The width x across the base of the semi-annular shape may vary from about 3 inches to about 6 inches to allow for differing breast sizes. The appliance 20 includes outlines 26, 28 and 30 to provide for adjustment of the overall size of the appliance by cutting along the outline. The outlines 26, 28 and 30 may be designated by letters B (32), C (34) and D (36) corresponding to the user's bra cup size. Other materials disposable or reusable may be used for the lift so long as the materials function for the intended purpose of providing some degree of lifting and/or adherence to the breast sufficient for lifting and maintaining the breast in a lifted position. As shown in FIG. 2front view the appliance includes a top surface 38 with no adhesive on this surface, as this top surface is what comes in contact with the users clothing and as shown in FIG. 1 bottom surface 40 having an adhesive surface covered with a peel-away layer 42, also shown at sides at 43, 43, and upon which outlines 32, 34 and 36 may be displayed.

Figure 3:
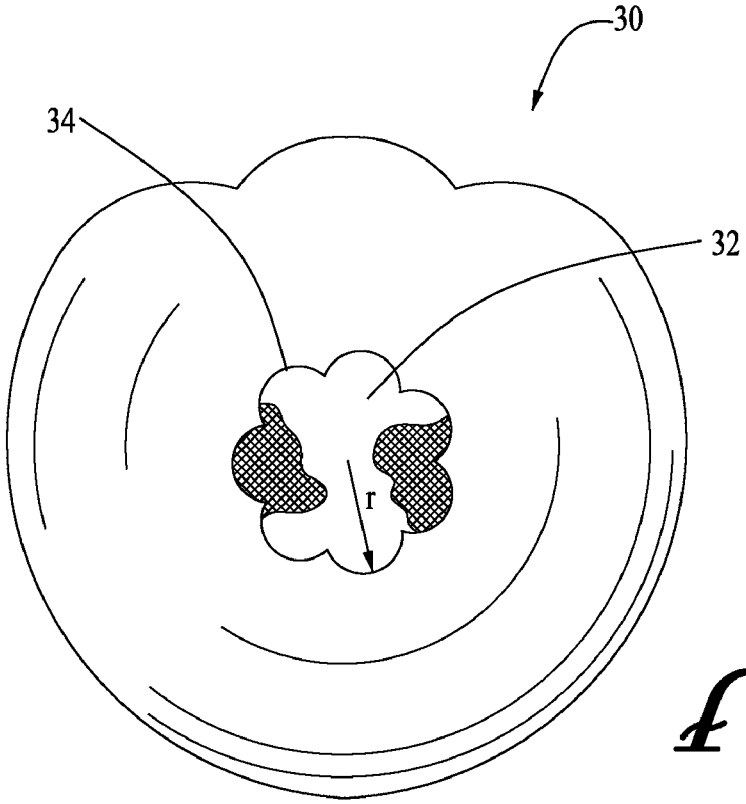
FIG. 3 is a back view of a second embodiment of an appliance for lifting a human breast, gathering and smoothing loose skin of a human breast and covering the nipple.
Figure 4:
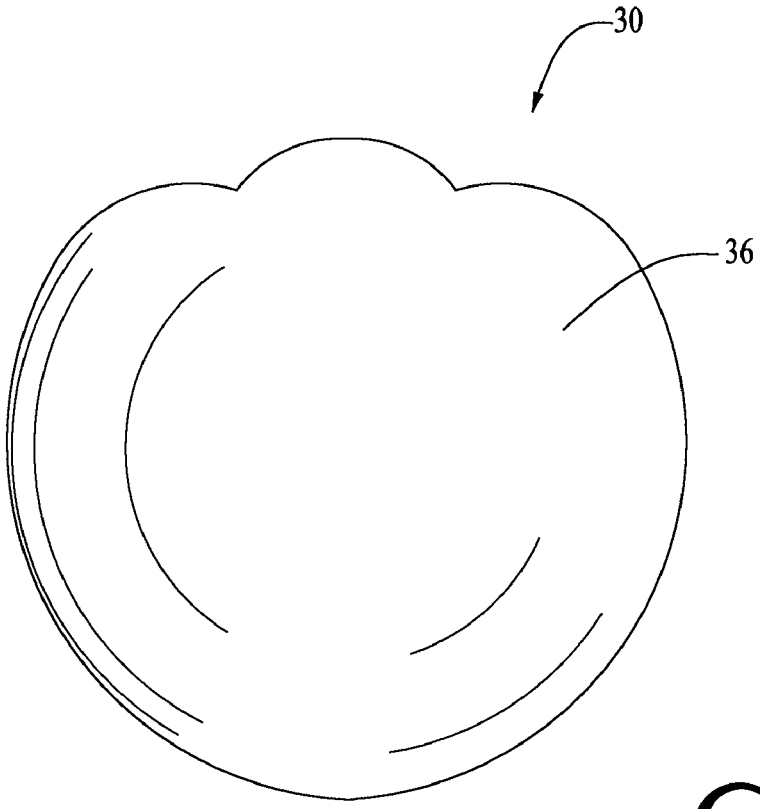
FIG. 4 is a front view of the FIG. 3 embodiment.

FIGS. 3-4 Embodiment

As shown in FIGS. 3 and 4 another preferred embodiment of the appliance or lift is intended for use in lifting and repositioning the breasts to a higher elevation, for lifting the nipple area of the breast to a higher elevation and for covering the nipple area of the breast. This embodiment may also be referred to as a lift or a "lift with nipple cover". With reference to FIG. 3, the appliance 30 is made of a flat disposable adhesive tape, preferable adhesive tape is 3M 9830 and has a generally circular shape with a nipple cover 32 adhered to the center region of the appliance. The nipple cover 32 is preferably made of a soft, non-abrasive material such as cotton, and may be layered. Preferably the nipple cover is sized and shaped and is of a thickness to cover the nipple protrusion. As shown in FIG. 3 the nipple cover has a radius r. The nipple cover 32 is optional, and when used is preferably adhered to the inside of the lift 30, with the side of the nipple cover that contacts the skin not having any adhesive. Alternatively, the appliance may be made in a size large enough to cover the nipple, but without a separated nipple cover, or with a separate nipple cover positioned on the outside of the appliance. In such embodiments the inside surface of the appliance may have adhesive contacting the nipple, or may be made with a central region adhesive free. Other materials may be used for the nipple cover, and without any added material for the nipple cover may be used so long as it functions for its intended purpose of covering the nipple and not causing irritation to the user. Other disposable or reusable materials may be used for the lift so long as the materials function for the intended purpose of providing some degree of lifting and/or adherence to the breast sufficient for lifting and maintaining the breast in a lifted position. The nipple cover 32 can be of a circular shape or can be of other shapes, such as for example a flower design 34 as shown in FIG. 3. The outer perimeter of the lift 30 preferably has a curved border, composed of one or more curves, but can be of other shapes. The preferred radius r of the nipple cover 32 is approximately 1 inch, but includes a range of radii of about 0.5 inch to about 1.5 inches. The width or diameter across the base of the lift 30 may vary from about 3 inches to about 6 inches to allow for differing breast size. The appliance 30 may include outlines to provide for adjustment of the overall size of the appliance by cutting along the outline, as described above with respect to FIG. 1. The FIGS. 3-4 embodiment, however, also may be made without the outlines, and may be made in various sizes. As shown in FIG. 4 the appliance 30 includes a top surface 36 with no adhesive on this surface, as this top surface is what comes in contact with the users clothing. The appliance has a bottom surface having an adhesive surface that is covered with a peel-away layer (not shown) and upon which outlines may be displayed.

Preferred Uses of the FIGS. 1-4 Embodiments

Figure 5:
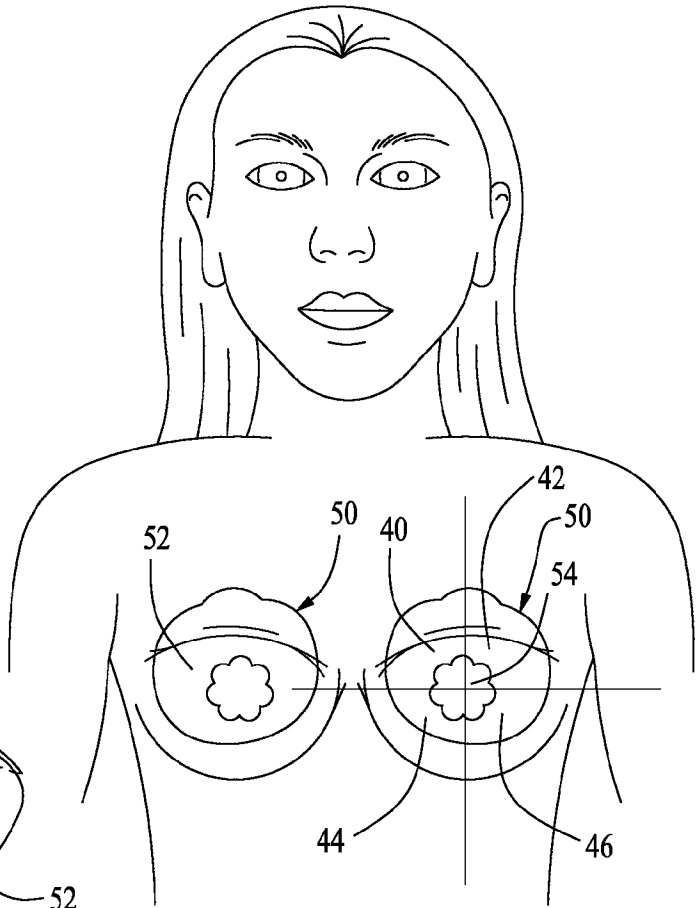
FIG. 5 is a front view of a third embodiment of an appliance for lifting a human breast, smoothing the skin of a human breast, shaping a human breast and covering the nipple.
Figure 7:
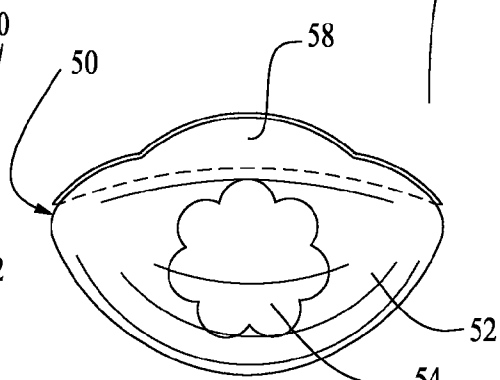
FIG. 7 is a front perspective view of the embodiment of FIG. 5.
Figure 8:
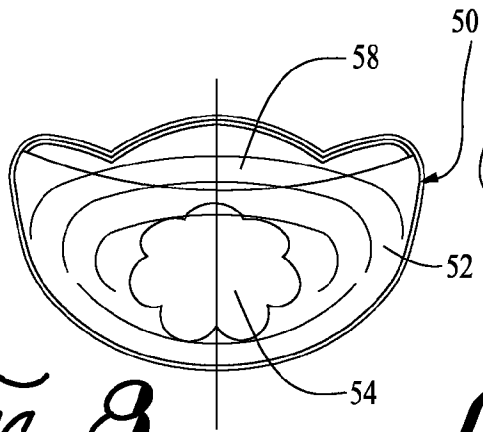
FIG. 8 is a back perspective view of the embodiment of FIG. 5.

A preferred method of using the appliances or lifts 20, 30 will be described with reference to the four quadrants of the human breast. The four quadrants are illustrated for the left breast as shown in FIG. 5, i.e., upper inner quadrant 40, upper outer quadrant 42, lower inner quadrant 44 and lower outer quadrant 46. The right breast also may be described with corresponding four quadrants, although they are not identified with reference numbers herein.

The preferred method of application or use includes some or all of the following steps. All or a portion of the peel-away layer is removed from the adhesive surface of the appliance. The appliance 20 is applied with the adhesive surface in contact with the skin of the upper surface of the breast so that the inner perimeter 22 of the semi-annulus is adjacent to and above the areola, and is adhered in that location. When an appliance 30 is used, the nipple cover 32 is placed over the nipple and areola. The thus partially applied appliance 20 or 30 is gently moved generally upwardly and/or rearwardly to lift the breast from the top, and in particular to lift the area of the areola and nipple, to a higher degree desired by the user. Once the breast has been thus lifted the desired amount, the remaining portion of the appliance is adhered to the skin of the upper surface of the breast and/or chest, to maintain the breast in the higher desired position FIGS. 5-9 Embodiment Shown in FIGS. 5-9 is another preferred embodiment of an appliance or lift 50 intended for use in lifting a human breast from the top of the breast, for smoothing the skin on the top area of the breast, for repositioning the breast to a higher elevation, shaping the breast and for concealing the nipple. The lift 50 is concave or in the shape of a cup and is made of a four-way stretchable silicone gel 52 and to which a reusable silicone adhesive is applied. Preferably a nipple cover 54 has been attached or adhered on the inside surface of the lift 50, with the side of the nipple cover that contacts the skin not having any adhesive, the inside being the side that contacts the breast during use. Other materials may be used for the nipple cover. The preferred silicone gel is Toshiba TSE221-3U-20K gel and the preferred adhesive is Dow Corning 7-9700 soft skin adhesive. Other materials may be used for the cup and/or the adhesive so long as the materials function for the intended purpose of providing some degree of lifting, shaping and/or adherence to the breast sufficient for lifting and maintaining the breast in a lifted position. Preferably the materials would also be reusable. In the preferred embodiment the nipple cover is also made of the silicone gel and is of a size and thickness to cover the nipple protrusion. The nipple cover can be of any of various shapes, such as a circular disc or with multiple curves at the outer perimeter to as to have a flower petal shape.

The nipple cover is adhered to the inside of the cup with the silicone adhesive on one side, and the other side of the nipple cover, the side that contacts the breast, preferably does not have adhesive. A peel-away layer may be applied to the inner surface of the appliance 50. In addition or, alternatively the appliance may be sold as overlying a hard, non-sticky plastic storage cup whose outer periphery or surface preferably conforms to the inner periphery or inner surface of the appliance. Nipple cover 54 is positioned on the inside surface of the lift so as to cover the nipple area. Shown in the FIG. 6 cross-sectional view is the silicone gel 52 that overlays the nipple cover or liner 54. Underneath the silicone gel 52 is the adhesive layer 56 and underneath the adhesive layer 56 is the nipple cover 54.

Figure 6:
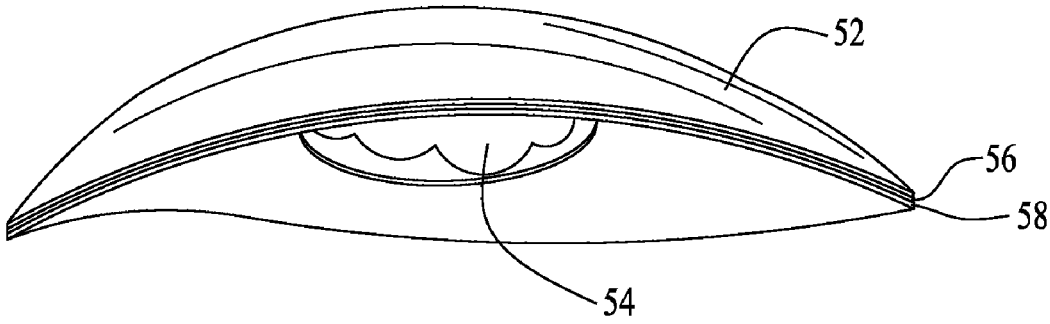
FIG. 6 is a cross-sectional view of the FIG. 5 embodiment.

In FIG. 6 an optional peel-away layer 58 is also shown. Conventional materials may be used for the peel-away layer so long as it functions for its intended purpose of covering the adhesive layer of the appliance prior to use, and permits removal by the user. The nipple cover is preferably made of the same silicone gel as is the appliance cup, and is preferably of a color different than that of the appliance. Preferably the stretchable sheet of the appliance is of a nude or transparent color, but other materials and colors or hues may be used so long as they perform the intended function of covering the nipple area of the breast. The thickness of the flexible, stretchable sheet or cup material 52 preferably is about 3 mils, although other thicknesses and other materials may be used so long as they function to perform the intended purposes of the appliance. One shape of the outer periphery of the lift 50 is shown as having a slightly scalloped edge and an opposing, lower smooth edge, and a flower petal type shape for the nipple cover 54 is shown. The shapes of the periphery of the lift 50 and nipple cover 54 may be varied, and may be made to form virtually any shape so long as each functions for its intended purpose, i.e., to provide a surface for the adhesive sufficient to lift the breast to which it is adhered, to shape the breast and/or to cover the nipple and/or surrounding area, respectively. The appliance may be made in various sizes, with larger sizes intended to be used to lift and shape larger breasts.

Preferred Methods of Using the FIGS. 5-9 Embodiment

A preferred method of using the FIGS. 5-9 lifts includes the following steps. The size of the appliance is selected according to the user's approximate bra cup size. The user should then make sure the skin on the breast is clean and dry. If the user's skin tends to become oily quickly, then the skin should be cleaned with rubbing alcohol on a cotton ball to cleanse away any remaining oil on the skin. The user should also keep oils, lotions and makeup away from the lifts. When cared for properly, the lifts will remain securely in place on the breast all day or all night long. For best results, the preferred way to maintain the lifts in good condition is to store the lifts on plastic storage cups, shown in FIGS. 17-18, at room temperature, away from heat, sunlight or moisture when not in use. When stored and used properly the lifts are reusable for up to about 25 times.

Figure 9:
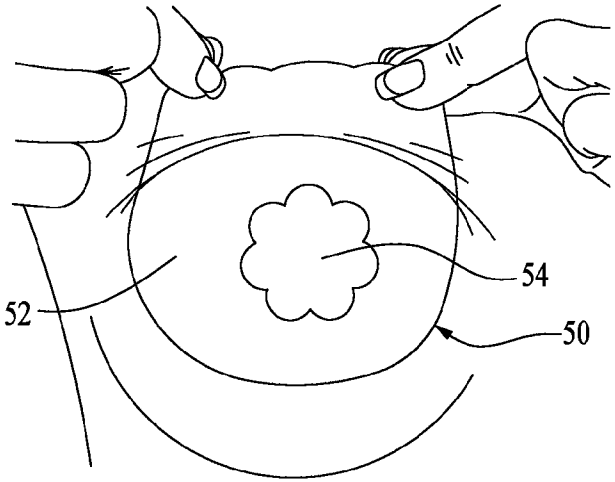
FIG. 9 is a front perspective view of the FIG. 5 embodiment shown during application to a human breast for lifting, smoothing and shaping.

Each lift may have an optional peel-away backing 58 that must be removed prior to application. Start by placing the nipple cover portion of the lift onto the nipple, so that none of the adhesive is touching the nipple. Then firmly press and smooth the bottom half of the lift and nipple cover onto the nipple, areola and against the breast skin just outside and all the way around the areola and under the breast in the lower inner and lower outer quadrants. Then lift the breast from the top with the partially applied appliance 50 in a gently moved generally upwardly and/or rearwardly to lift the breast from the top, and in particular to lift the area of the areola and nipple, to a higher degree desired by the user. Once the breast has been thus lifted to the higher desired amount, the remaining portion of the adhesive backed portion of the lift should be pressed firmly in place in the upper inner quadrant, shown, for example as left breast upper inner quadrant 40 in FIG. 5 and the upper outer quadrant, shown for example at 42, just above the areola area before lifting. As shown in FIG. 9, the lifting action takes place at and from the topside of the breast, that is, from the upper inner and upper outer quadrants; not from underneath the breast from the lower inner and lower outer quadrants.

Once the lower part of the nipple cover of the appliance is securely in place on the breast, then the user holds the top part of the lift and pulls the lift upward to the desired position as shown in FIG. 9. Then the user firmly presses and smoothes the top part of the appliance against the breast skin. With this shaped cup applied as described the result is that the breast is shaped, lifted loose skin is gathered and smoothed and the nipple covered. This procedure is then repeated for the other breast.

In an alternate method of application, all or a portion of the peel-away layer is removed from the adhesive-containing surface of the appliance. The appliance is applied to the top area of the breast, that is, to the area closer to the head and chin of the user (upper inner and outer quadrants), so that the adhesive surface is in contact with the skin of the area near and the nipple and areola. The nipple cover is placed directly on the nipple and areola. Then the adhesive-containing surface of the appliance is placed in contact with the surrounding breast skin of the upper surface of the breast so that the appliance is adhered in that location. The partially applied appliance is then gently moved, preferably and generally upwardly toward the head and chin of the user, and/or rearwardly toward the back of the head of use so as to lift the appliance and the top of the breast to the degree desired by the user. Once the nipple has been covered and the breast has been thus lifted the desired amount, the remaining portion of the peel-away layer is removed (if it has not been previously removed) and the remaining portion of the appliance's gel sheet or cup is adhered to the skin of the user to maintain the breast in the desired position. As will be appreciated the steps of the process of application of the appliance may be varied, and the peel-away layer may be entirely removed prior to the first application of the appliance to the skin.

FIG. 10 Embodiment

Figure 10:
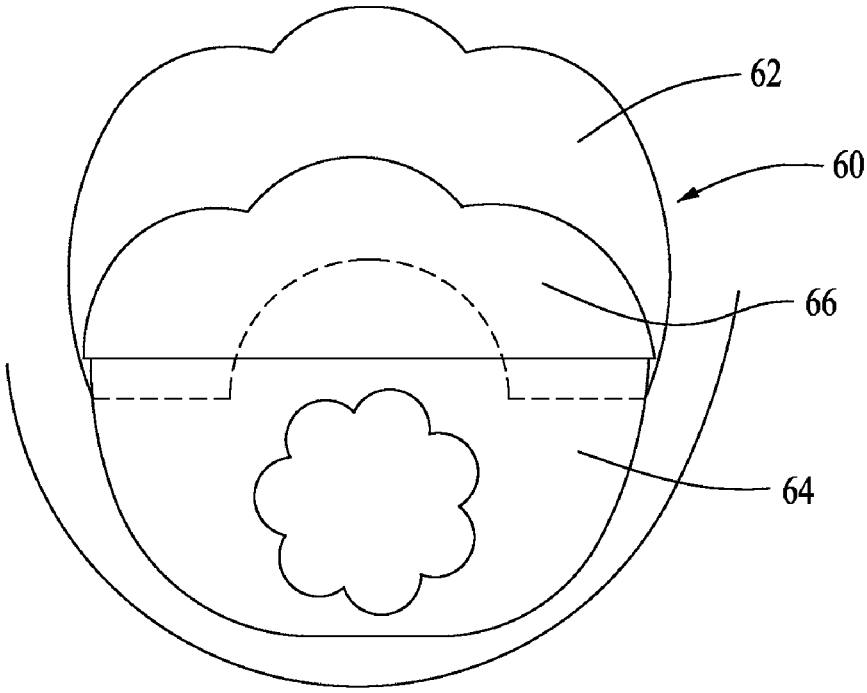
FIG. 10 is a front perspective view of a fourth alternate embodiment of a combination of FIG. 1 and FIG. 5 appliance for lifting a human breast, gathering, smoothing and shaping a human breast shown in place on a user.

Shown in FIG. 10 is an example of another preferred embodiment 60. The embodiment of FIG. 10 preferably is a combination of the embodiment of FIGS. 1-2 and any of the embodiments of FIGS. 5-9. As shown in FIG. 10 a disposable lift 62, of the type and shape of FIGS. 1-2 is first adhered to the user and under a reusable lift 64, which is then adhered over the lift 62. Shown in FIG. 10 in dashed lines is also an optional peel-away layer portion 66 that has not yet been peeled away from the reusable lift 64. The FIG. 10 embodiment is intended for use in lifting a human breast from a first, typically lower position to a second, typically higher position, shaping the breast into a desired cup shape and maintaining the lifted and shaped breast in the second, higher position. The FIG. 10 embodiment is preferably used on relatively large breasts, such as D cup size and above because it provides significantly greater lifting capability. In general the FIG. 10 embodiment involves applying an appliance as shown and described with reference to FIGS. 1-2 and then applying one of the embodiments shown and described with reference to FIGS. 5-9. In this embodiment additional lifting power and breast shaping capability is provided. In general the lifting power of the disposable embodiment of FIGS. 1-2 is stronger than is the adhesive power of the reusable appliance of the FIGS. 5-9 embodiments. Thus, with a larger, heavier breast, the additional lifting that can be applied by both appliances provides for a significantly better result.

FIGS. 11-18 Embodiments

Figure 11:
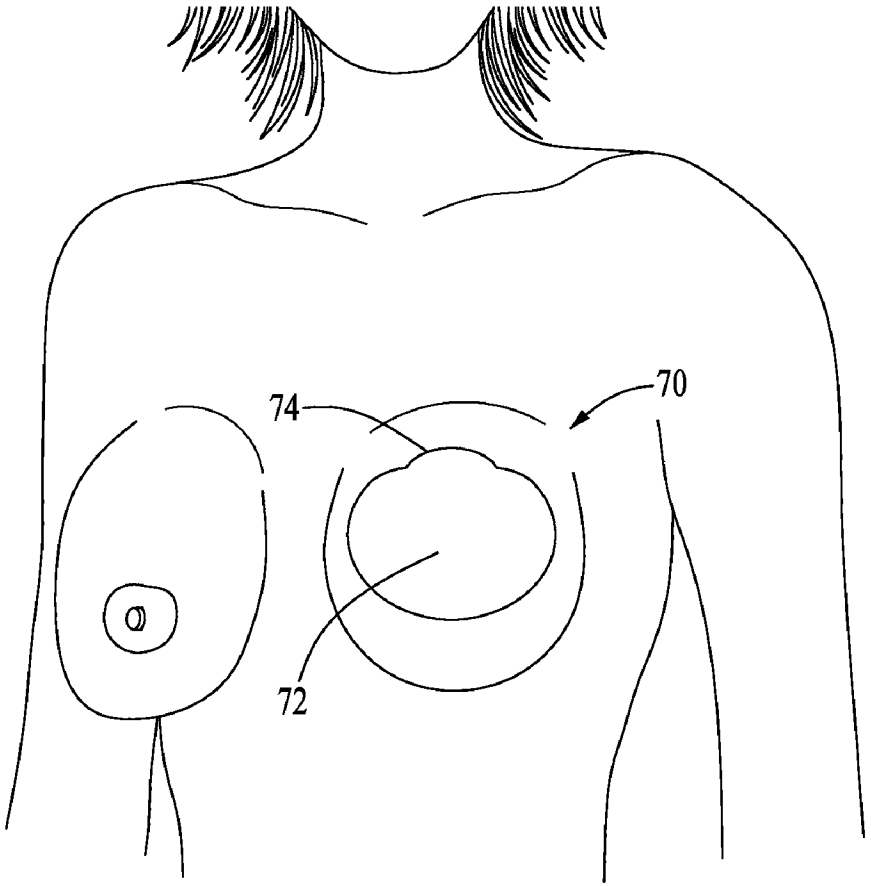
FIG. 11 is a front perspective view of a fifth alternate embodiment of an appliance for lifting a human breast, gathering and smoothing the loose skin of a human breast, shaping a human breast and covering the nipple shown in place on a user, and a sagging breast without a breast lifting appliance.
Figure 14:
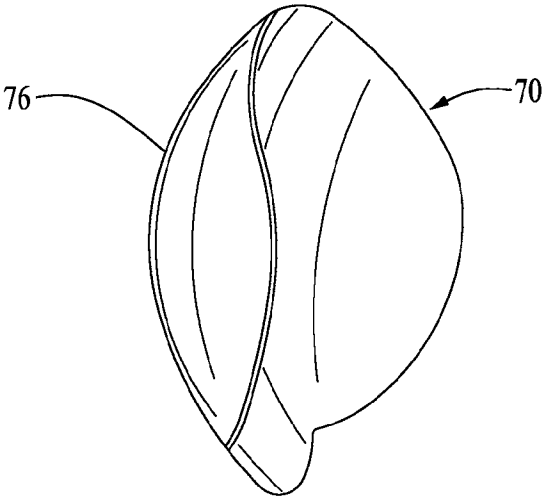
FIG. 14 is a perspective view of the FIG. 11 embodiment taken from the side and back.
Figure 16:
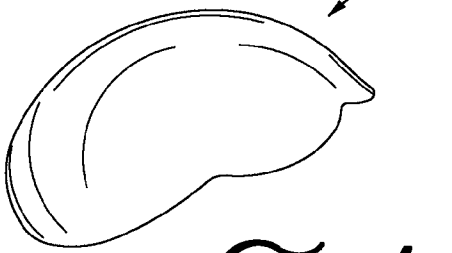
Figure 13:
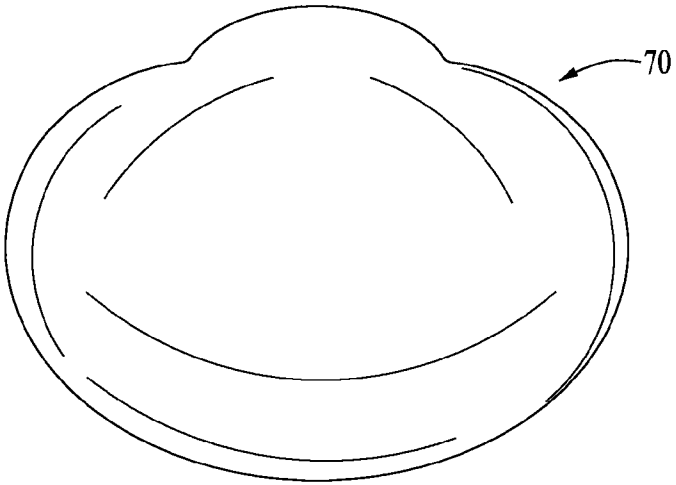
FIG. 13 is a front view of the FIG. 11 embodiment.
Figure 15:
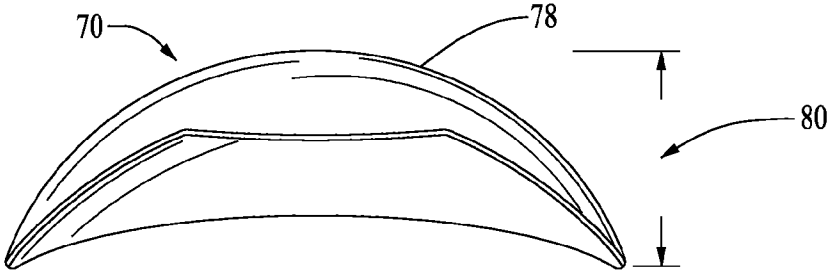
FIG. 15 is a perspective view of the FIG. 11 embodiment taken from the top and back; and, FIG. 16 is a perspective view of the FIG. 11 embodiment taken from the top, front and side of the appliance.

Shown in FIGS. 11-18 is another alternate embodiment of a breast lifting and nipple covering appliance or lift 70. FIG. 11 also shows a sagging breast in which the breast and nipple has dropped or sagged. The lift 70 is made of a reusable silicone gel, preferably the same Toshiba TSE221-3U-20K gel as in the FIGS. 5-9 embodiment, and the preferred adhesive is also the reusable Dow Corning 7-9700 soft skin adhesive. The lift 70 is of a unitary construction, without a separate nipple cover that is adhered to the inner surface of the cup. The reusable adhesive is applied to the inner surface of the appliance except for a central region 72 that is intended to cover the nipple area during use. Lift 70 is preferably made of a single piece of silicone gel material that covers the breast, as compared to the embodiment of FIGS. 5-9 in which the nipple cover is made of a separate piece of material that may be the same type or may be of a different type of material.

Figure 12:
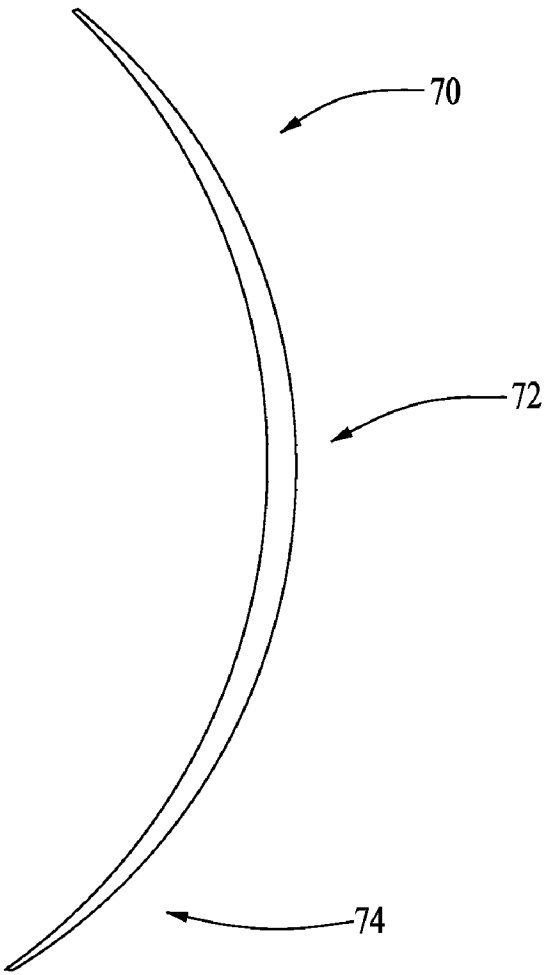
FIG. 12 is a cross-sectional view of the FIG. 11 embodiment.

As shown in FIG. 11 and in the cross-sectional view of FIG. 12 the thickness of the lift 70 tapers from a relatively thick center region 72 to a relatively thin outer region 74. The presently preferred thickness for the center is about 3 mm and for the outer edge is about 0.75 mm. Different thicknesses and degrees of taper are considered to be equivalent so long as they permit the lift to perform its intended functions. The lift 70 is preferably of a size such that it will cover a substantial portion of a breast, and may be of various sizes to accommodate different breast sizes.

As shown in FIGS. 13-16 the front of the lift 70 has a preferred height arc 76 of about 108 mm. The front of the lift 70 has a preferred width arc 78 of about 151 mm, and a preferred depth arc 80 of about 42.2 mm. As will be appreciated these dimensions may be varied without departing from the spirit and scope of the invention. Preferably the entire lift 70 will be of a single color, most preferably of a nude or skin color, although the lift could also be transparent or semi-transparent.

The lift 70 facilitates placing the breast into a perfect or otherwise desired shape. It also can be worn all day, that is, about 12 hours without slipping. Additionally, the lifts 70 can be placed or pulled to the center (inner upper and lower quadrants) to create relatively more cleavage, or placed or pulled to the outer quadrants create relatively less cleavage.

Figure 17:
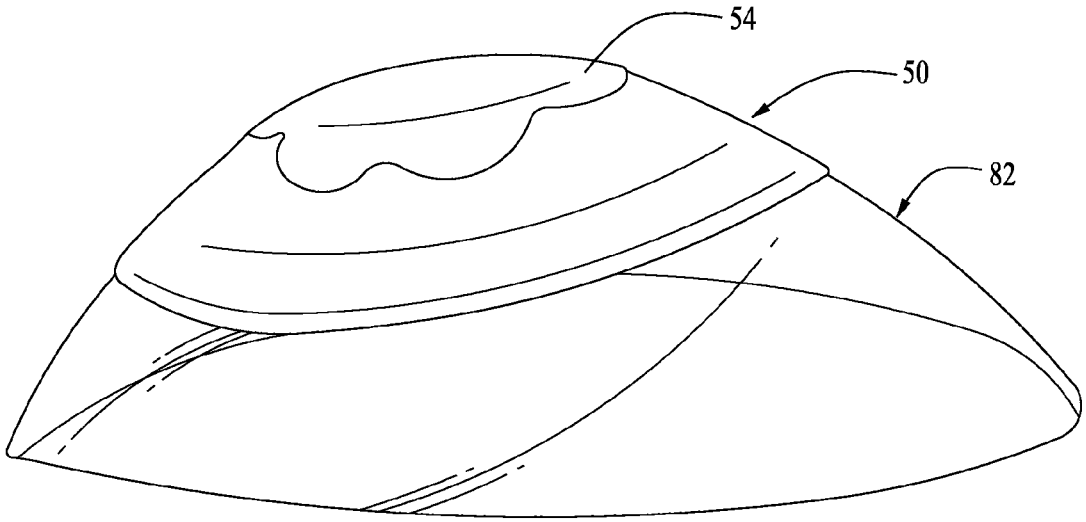
FIG. 17 is a front, side perspective view of the FIG. 5 embodiment as placed on a preferred storage cup; and, FIG. 18 is a rear, side perspective view of the FIG. 5 embodiment as place on the preferred storage cup of FIG. 17.
Figure 18:
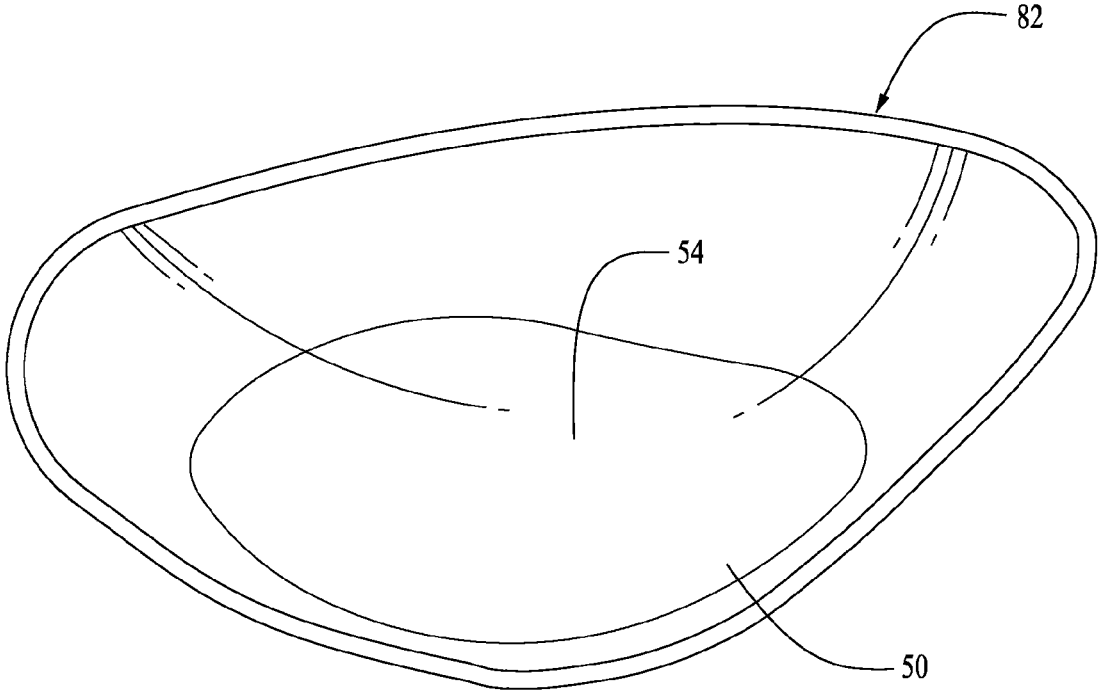

Shown in FIGS. 17 and 18 are front and rear perspective views of a preferred plastic storage cup 82 upon which a lift 50, with its separately attached nipple cover 54 is placed. The cup 82 is preferably a hard, plastic whose outer surface generally conforms to the inner surface of the lift, such as lift 50. In general the cup has radii of curvatures that correspond to those of the appliance, but are longer so as to provide a stable surface upon which to store the reusable lifts.

Additional Advantages and Uses of the FIGS. 1-16 Embodiments

The embodiments of the FIGS. 1-16 lifts are also advantageous because they address a condition known as "falling off the cliff". This condition refers to a situation when a user or patient has had a breast implant, typically in the past, and as time passes the implant has remained in place after the implant surgery but, eventually the nipple starts to slide as gravity takes effect and it moves downward from where it was immediately after the surgery to a lower, sometimes much lower position on the implant. As is known, the nipple ends up pointing downward on one or both of the breasts. For example, the lift 50 addresses this condition by lifting the nipple to a higher position, even to the original position just after the surgery, and additionally, tucks in the loose skin that typically accompanies this condition. This lifting and shaping makes the breast appear to be natural, and to not appear to be sagging. The lift brings the breast tissue, surrounding skin and nipple up to the place of the implant, and thus makes the shape of the breast look natural. This has saved many women from having to go back under the knife when the condition starts to become noticeable.

The "falling off the cliff" condition starts gradually, and in its early stages can successfully be addressed through use of the FIGS. 1-4 embodiments. In this stage of the condition, the appliance addresses the problem primarily by lifting the sagging nipple(s). As the condition worsens, increased lift and coverage is needed to address the condition and then one of the FIGS. 5-16 embodiments may be used to provide the lift and shaping that is needed to address the specific situation faced by a specific patient or user. With the objective typically being to return or make the breast look as natural as possible, the type and size of appliance is chosen to provide the minimum lift needed and to cover the nipple. As more shaping and skin tucking is needed the embodiments of FIGS. 5-16 will provide the needed lifting of the breast from the top, coverage of the nipple and/or shaping of the breast. No matter how far the nipple may have dropped due to the condition, one of the appliances as herein described has the capability of returning to and maintaining the breast and nipple to a chosen elevated position, so that the nipple is place higher up on the implant, where is was originally intended to be.

The embodiments of FIGS. 5-16 additionally have use in combination with fashion bras, i.e., bras that provide relatively little support for the breasts. For users who have sagging breasts, and want to wear such a fashion bra the lifts of FIGS. 5-16 provide for shaping the breasts in a way that compliments the fashion bra so that the breasts have a more youthful, uplifted, firmer, shapelier appearance. The typical fashion bra, that is, one with very thin straps and very little support for the breasts are often avoided by women whose breasts sag, because the sagging appearance remains when wearing this type of bra. Thus, use of the silicone gel cup type lifts described herein with fashion bras provides an entirely new function heretofore unavailable.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A method of lifting a human breast and comprising:

providing a sheet made of translucent material, having an adhesive applied to one side of the sheet, having a size and lifting capability sufficient to lift a human breast including but not limited to the breast nipple and having a peel-away layer of material covering the adhesive;

removing at least part of the peel-away layer to expose the adhesive;

applying a part of the sheet to upper inner and upper outer quadrants of the breast so that the adhesive contacts the breast;

moving the sheet generally upwardly, or upwardly and rearwardly to lift the breast from the top to a lifted position;

removing any peel-away layer remaining covering the adhesive; and, applying the remaining part of the sheet to upper inner and upper outer quadrants of the breast and/or to the chest of the user to maintain the breast in the lifted position.

2. A method of lifting and shaping a human breast comprising:

providing a first appliance made of a sheet made of translucent material, having an adhesive applied to one side of the sheet, having a size and lifting capability sufficient to lift a human breast including but not limited to the breast nipple and having a peel-away layer of material covering the adhesive;

removing at least part of the peel-away layer to expose the adhesive;

applying a part of the sheet to upper inner and upper outer quadrants of the breast so that the adhesive contacts the breast;

moving the sheet generally upwardly, or upwardly and rearwardly to lift the breast from the top to a lifted position;

removing any peel-away layer remaining covering the adhesive;

applying the remaining part of the sheet to upper inner and upper outer quadrants of the breast and/or to the chest of the user to maintain the breast in the lifted position;

providing a second appliance made of a stretchable silicone gel form sized and shaped to conform to a substantial portion of a human breast, and having a reusable, silicone adhesive applied to at least a part of one side of said form;

applying a part of said form to upper inner and upper outer quadrant areas of the breast, over a substantial portion of the first appliance and so that at least part of the adhesive contacts the breast;

moving said form to stretch said form to provide a stretched form and to move the breast to a desired position and shape; and, applying the remaining part of said stretched form to upper inner and upper outer quadrant areas of the breast and/or to the chest of the user to maintain the breast in the desired position and shape.

3. A method of lifting, smoothing and shaping a human breast comprising:

providing a molded, cup-shaped, stretchable silicone gel form having a center region, having an inside surface generally complementary to the shape and size of a substantial portion of the human breast and having a reusable, silicone adhesive applied to at least a part of one side of the cup-shaped sheet;

applying a part of the cup-shaped form to upper inner and upper outer quadrant areas of the breast so that at least part of the adhesive contacts the breast;

lifting and stretching the cup-shaped form to move the breast to a desired elevated position, to gather breast skin to form a crease, shape and smooth the breast skin; and, applying the remaining part of the stretched cup-shaped form to upper inner and upper outer quadrant areas of the breast to maintain the breast in the desired elevated position and smooth shape.

* * * * *